US010533284B2

(12) United States Patent
Dauner et al.

(10) Patent No.: US 10,533,284 B2
(45) Date of Patent: Jan. 14, 2020

(54) METHOD FOR OPERATION OF A HEATING GROUP SUBSYSTEM, AND HEATING GROUP SUBSYSTEM

(71) Applicant: Voith Patent GmbH, Heidenheim (DE)

(72) Inventors: Martin Dauner, Herbrechtingen (DE); Thomas Mack, Sontheim (DE); Christoph Adams, Augsburg (DE); Frank-Udo Schönborn, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 111 days.

(21) Appl. No.: 15/816,143

(22) Filed: Nov. 17, 2017

(65) Prior Publication Data

US 2018/0171555 A1 Jun. 21, 2018

(30) Foreign Application Priority Data

Dec. 21, 2016 (DE) ..... 10 2016 125 172

(51) Int. Cl.
*D21F 5/04* (2006.01)
*D21F 5/02* (2006.01)
*D21F 5/20* (2006.01)

(52) U.S. Cl.
CPC ..... *D21F 5/04* (2013.01); *D21F 5/028* (2013.01); *D21F 5/20* (2013.01)

(58) Field of Classification Search
CPC ..... D21F 5/04; D21F 5/028; D21F 5/20
USPC ..... 34/463
See application file for complete search history.

(56) References Cited

U.S. PATENT DOCUMENTS 4,202,113 A * 5/1980 Kankaanpaa ..... D21F 5/042 162/207
4,622,758 A * 11/1986 Lehtinen ..... F26B 13/105 34/116
4,625,430 A * 12/1986 Aula ..... D21F 5/04 34/116
4,932,139 A * 6/1990 Lehtinen ..... D21F 5/004 34/454

(Continued)

FOREIGN PATENT DOCUMENTS

AT 384 254 B 10/1987
DE 10 2008 041 860 A1 3/2010

(Continued)

OTHER PUBLICATIONS

Request for Examination dated Sep. 12, 2017 for German Application No. 10 2016 125 172.0 (10 pages).

*Primary Examiner* — Stephen M Gravini
(74) *Attorney, Agent, or Firm* — Taylor IP, P.C.

(57) ABSTRACT

A method for operating a heating group subsystem of a machine for the production or treatment of a fibrous web. The heating group subsystem includes a first heating group and a last heating group and at least one additional heating group; in each case having at least one device that is heated with pressurized heating steam. Viewed in a direction of travel, the fibrous web is fed first through the first heating group, then through the at least one additional heating group, and thereafter through last heating group. The steam pressure of the heating steam of the at least one additional heating group is adjusted lower than the respective steam pressure of the heating steam of first heating group and of last heating group.

18 Claims, 3 Drawing Sheets

(56) References Cited

U.S. PATENT DOCUMENTS 5,033,207 A * 7/1991 Sturm ..... B65H 23/24 34/115
5,416,980 A * 5/1995 Ilvespaa ..... D21F 5/04 34/116
5,586,397 A * 12/1996 Kerttula ..... D21F 5/04 34/114
5,592,751 A * 1/1997 Guggemos ..... D21F 5/00 162/197
5,594,996 A * 1/1997 Haavisto ..... F26B 3/20 34/119
5,628,124 A * 5/1997 Skaugen ..... D21F 5/04 34/117
5,791,065 A * 8/1998 Gamble ..... F26B 13/186 165/89
5,832,625 A * 11/1998 Skaugen ..... D21F 5/04 34/117
5,850,701 A * 12/1998 Graf ..... D21F 5/04 34/117
H1789 H * 3/1999 Brown ..... 34/116
6,003,241 A * 12/1999 Komulainen ..... D21F 5/04 34/117
6,085,437 A * 7/2000 Stipp ..... D21F 5/006 34/115
6,094,838 A * 8/2000 Lang ..... D21F 5/044 34/117
6,101,735 A * 8/2000 Kuhasalo ..... D21F 5/044 162/207
H1906 H * 11/2000 Brown ..... 34/117
6,219,934 B1 * 4/2001 Moskowitz ..... D21F 5/042 34/117
7,690,131 B2 * 4/2010 Mausser ..... D21F 5/021 162/358.1
8,011,115 B2 * 9/2011 Komulainen ..... D21F 5/042 131/365
8,402,673 B2 * 3/2013 Da Silva ..... D21F 5/182 162/206
8,444,824 B2 * 5/2013 Juppi ..... D21F 5/042 162/289
8,544,184 B2 * 10/2013 Da Silva ..... D21F 5/182 162/358.1
8,608,909 B2 * 12/2013 Scherb ..... D21F 1/0036 162/358.1
9,605,381 B2 * 3/2017 Turcotte ..... D21F 5/042
9,777,414 B2 * 10/2017 Okuda ..... D04H 1/54
2002/0116838 A1 * 8/2002 Kahl ..... D21F 5/044 34/444
2018/0119323 A1 * 5/2018 Thies ..... D06B 1/02
2018/0171555 A1 * 6/2018 Dauner ..... D21F 5/028

FOREIGN PATENT DOCUMENTS

DE 10 2010 044 072 A1 6/2011
DE 102016125172 A1 * 6/2018 ..... D21F 5/028
EP 2106483 B1 * 3/2016 ..... D21F 5/182
EP 3339507 A1 * 6/2018 ..... D21F 5/028
WO 2014/180645 A1 11/2014

* cited by examiner

METHOD FOR OPERATION OF A HEATING GROUP SUBSYSTEM, AND HEATING GROUP SUBSYSTEM

BACKGROUND OF THE INVENTION

1. Field of the Invention

The present invention relates to a method for operating a heating group subsystem in a machine for the production or treatment of a fibrous web, for example a paper or cardboard web. The invention also relates to a heating group subsystem in a machine for the production or treatment of a fibrous web, for example a paper or cardboard web.

2. Description of the Related Art

Document WO 2014/180645 A1 discloses a cascade steam system for a dryer section in a paper machine, wherein the steam pressure of the heating steam is higher in the first heating group than in the second heating group, and the steam pressure of second heating group is higher than the steam pressure in the third heating group. The heating system is arranged such that the steam pressure of the heating groups increases in machine direction. A thermo-compressor is provided to reduce the energy consumption. The thermo-compressor increases the vapor pressure in the last heating group to such an extent that it can again be fed to the heating group system in the form of heating steam.

Document AT384254 B also describes a cascade steam system for a dryer section of a paper machine wherein the steam pressure of the heating steam in the first heating group is higher than in the second heating group, and the steam pressure of the second heating group is higher than the steam pressure in the third heating group. The heating group system is arranged such that the steam pressure of the heating groups increases in the machine direction. The vapor of the heating group with the lowest pressure level is condensed in a heat exchanger for heating of the machine air, and an auxiliary condenser.

What is needed in the art is a heating system with improved energy efficiency and a more flexible mode of operation, as well as providing reduced energy consumption for the drying of paper.

SUMMARY OF THE INVENTION

The present invention provides a heating group subsystem and a method for the production or treatment of a fibrous web.

The invention in one form is directed to a method for the operation of a heating group subsystem for a machine for the production or treatment of a fibrous web, for example a paper or cardboard web, wherein the heating group subsystem includes a first heating group and a last heating group and at least one additional heating group in each case having at least one device that is heated with pressurized heating steam, in particular a drying cylinder for heating of the fibrous web. The fibrous web—viewed in machine direction—is guided first through the first heating group, then through the at least one additional heating group and thereafter through the last heating group. The steam pressure of the heating steam of the at least one additional heating group is adjusted lower than the respective steam pressure of the heating steam of the first heating group and the last heating group.

The invention in another form is directed to a heating group subsystem for a machine for the production or treatment of a fibrous web, for example a paper or cardboard web, wherein the heating group subsystem includes a first heating group and a last heating group and at least one additional heating group in each case having at least one device that is heated with pressurized heating steam, in particular a drying cylinder for heating of the fibrous web. The fibrous web—viewed in machine direction—is guided first through the first heating group, then through the at least one additional heating group and thereafter through the last heating group. The steam pressure of the heating steam of the at least one additional heating group is lower than the respective steam pressure of the heating steam of the first heating group and the last heating group.

The heating group subsystem represents part of the overall heating group system in a machine for the production or treatment of a fibrous web, for example a paper or cardboard web. Viewed in the machine direction, additional heating groups can thus be arranged after the heating group subsystem.

For drying of the fibrous web, the heating group subsystem is installed in a dryer section in a paper machine. In some cases, for example if the fibrous web is coated or glued, the dryer section is separated into a pre-dryer section and an after-dryer section. It is possible that the heating group subsystem is installed in the pre-dryer section and/or after drying section.

The heating group subsystem can be arranged in such a way that the first heating group of the heating group subsystem is the first heating group in the machine direction. The heating group subsystem is thus arranged at the beginning of the dryer section. The first heating group therefore supplies the first or the several first devices that are heated with pressurized heating steam. This may also be applied accordingly on a pre-dryer section and/or an after-dryer section. In contrast to the known state of the art of the cascade heating systems, the steam pressure of the heating steam of the at least one additional heating group is lower than the steam pressure of the first heating group. The at least one additional heating group is arranged between the first heating group and the last heating group.

The heating group subsystem according to the invention comprises three heating groups. Viewed in the machine direction, the at least one additional heating group represents the second heating group in this case.

It is also conceivable that the inventive heating group subsystem comprises four heating groups. Thus, two additional heating groups are provided which, in this case represent the second and third heating group. The steam pressure of the heating steam of the two additional heating groups is respectively lower than the respective steam pressure of the heating steam of the first and the last heating group.

It is moreover also possible that the heating group subsystem according to the invention includes more than four heating groups. Thus, accordingly more than two additional heating groups are provided. The steam pressure of the heating steam of the additional heating groups is always lower than the respective steam pressure of the heating steam of the first heating group and the last heating group.

With this inventive solution, all vapors that result during production operation of the machine in the heating groups of the heating group subsystem are fed into specific steam supply lines for the heating groups and are thus fed to the respective heating steam for drying of the fibrous web. Thus, all vapors—without condensing them—are reused directly for drying of the paper.

The steam pressure of the heating steam of the first heating group can be adjusted equal to or higher than the steam pressure of the heating steam of the last heating group.

For the second case, the steam pressure of the heating steam of the first heating group is therefore the highest steam pressure in the heating group subsystem. Viewed in the machine direction, the fibrous web is subjected to high temperature and is significantly heated at the beginning of the dryer section.

In another embodiment, the steam pressure of the heating steam of the at least one additional heating group is adjusted within the range between 50 kPa and 700 kPa above atmospheric pressure, for example between 50 kPa and 400 kPa.

The steam pressure of the heating steam of the first heating group may be in the range between 200 kPa and 1000 kPa above atmospheric pressure; and the steam pressure of the heating steam of the last heating group in the range between 300 kPa and 900 kPa above atmospheric pressure.

In another embodiment, the heating steam—after flowing through the respective device of a heating group that is heated with steam—is fed to a separator for separating condensate and exhaust vapor. The exhaust vapor of the first heating group and the exhaust vapor of the at least one additional heating group and the exhaust vapor of the last heating group are fed to the heating steam of the device that is heated with steam of the at least one additional heating group.

The exhaust vapor of the at least one additional heating group is fed via a thermo-compressor to the heating steam of the device that his heated with steam of at least one of the at least one additional heating group. The thermo-compressor is hereby supplied with live steam from a steam supply system, wherein the steam pressure of the live steam is higher than the steam pressure of the heating steam of the heating groups.

Viewed in the machine direction of the machine that comprises a dryer section, the heating group subsystem can be located at the beginning of a dryer section in a paper machine.

The steam pressure of the heating steam of the first heating group is selected equal to or higher than the steam pressure of the heating steam of the last heating group.

The respective heating group and thus, the respective at least one device that is heated with heating steam is connected via a steam feed line with a steam supply line. A separator is allocated to each heating group for separating condensate and exhaust vapor. In each case, the respective separator is connected via a discharge line with the respective heating group and the respective device that is heated with steam. In each case, the separator of the first heating group and the separator of the at least one additional heating group and the separator of the last heating group are connected via a vapor line with the steam supply line of the at least one additional heating group.

The steam supply line can be connected with a steam supply system whose steam pressure is higher than the steam pressure of the heating steam of the heating groups.

In another embodiment, the vapor line for the vapor from the separator of the at least one additional heating group is connected via a thermo-compressor with the steam supply line for the purpose of condensation, wherein the thermo-compressor is connected with the steam supply line.

The respective condensate line of the separator of the first heating group and of the separator of the last heating group can be connected with the discharge line of one of the at least one additional heating group.

According to another embodiment, the vapor line of the first heating group comprises a backflow prevention device, for example a check valve. This may be advantageous if the heating group subsystem is being operated as a cascade heating system—for example in the production of certain types of paper—wherein in such a case, viewed in the machine direction the first heating group of the heating group subsystem has the lowest steam pressure of the heating steam of all heating groups of the heating group subsystem; and the at least one additional heating group of the heating group subsystem has the second lowest steam pressure.

By way of this heating system arrangement, a flexible mode of operation is achieved for the different requirements in the production of different fibrous webs on a machine. The backflow prevention device prevents the heating steam of the at least one additional heating group from flowing back through the vapor line into the separator of the first heating group.

In an additional embodiment, a vacuum separator is provided for the generation or provision of vapor from condensate in the negative pressure area, which is connected via a vapor line with a thermo-compressor, wherein the vapor of the vacuum separator is condensed by the thermo-compressor and is fed to the steam supply line of the first heating group. This may be advantageous if the heating group subsystem—for example in the production of certain paper types—is operated as a cascade heating system. With this design of the heating system, an energy efficient and flexible construction with low energy consumption is achieved also for the different requirements that occur in the production of different fibrous webs on one machine.

It is also possible to provide additional heating groups between first heating group HG1 and last heating group HG3, wherein these additional heating groups also have a steam pressure that is less than the steam pressure of the first heating group and less than the steam pressure of the last heating group, which in this example is the third heating group. The condensate lines and vapor lines can then be connected accordingly to the inventive heating group subsystem with the steam feed lines or respectively the discharge lines of one of the at least one additional heating group or the second heating group.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1A:
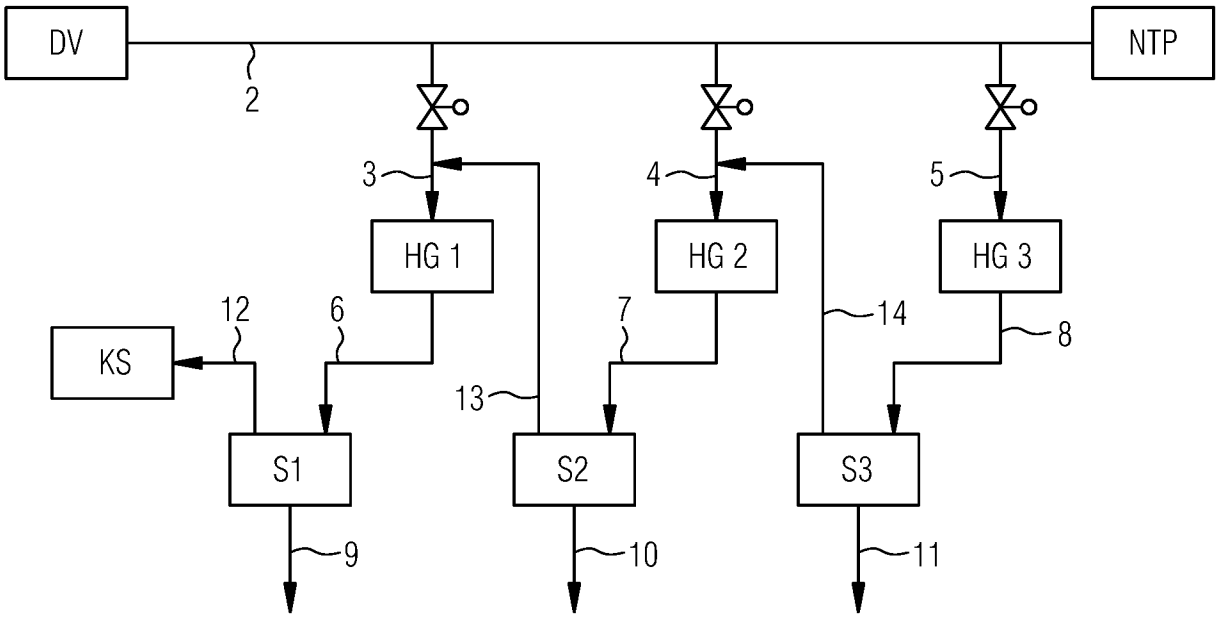
FIG. 1*a* is a schematic illustration of a heating group subsystem known in the art.
Figure 1B:
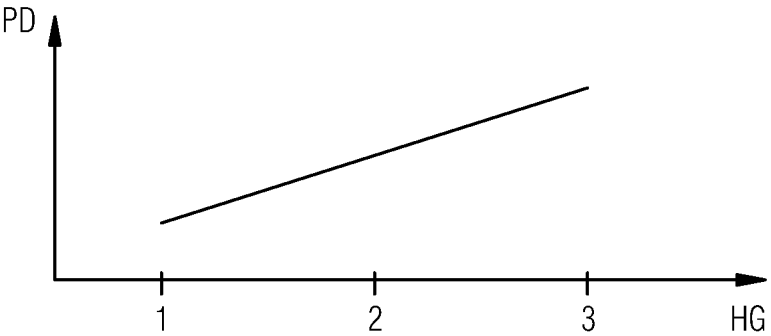
FIG. 1*b* illustrates the steam pressure of the heating steam of the individual heating groups known in the art.

FIGS. 1*a*-1*b* represent a heating group subsystem for a dryer section in a paper machine with dryer cylinders, according to the current state of the art, which is designed as a cascade heating system consisting of 3 heating groups HG1, HG2, HG3. The heating groups are heated with heating steam. Steam feed lines 3, 4, 5 are connected with a steam supply line 2. Steam supply lines 2 are supplied with heating steam by a steam supply system DV. In respect to the machine direction, heating groups HG1, HG2, HG3 are arranged one after another. Heating group HG1 thus forms the first heating group and supplies the first dryer cylinder with heating steam. Steam supply line 2 also supplies an after-dryer section NTP with steam. The volume of heating steam for each heating group is adjustable through valves. After the heating steam of one heating group HG1, HG2, HG3 has flowed through the dryer cylinders, the mixture of exhaust vapor and condensate is fed via discharge lines 6, 7, 8 to a respective separator S1, S2, S3 for separation of exhaust vapor and condensate. The respective condensate is discharged via condensate lines 9, 10, 11. The exhaust vapor of heating group HG3 is fed from separator 3 via vapor line 14 to steam feed line 4 of second heating group HG2. Accordingly, the exhaust vapor of heating group HG2 is fed from separator 2 via exhaust vapor line 13 to steam feed line 3 of first heating group HG1. In contrast, the exhaust vapor of heating group HG1 is fed from separator 1 via exhaust vapor line 12 to a condenser KS where it is condensed. The latent heat of the exhaust vapor of heating group HG1 is therefore not used directly for paper drying. As illustrated in FIG. 1*b*, steam pressure PD of the heating steam in heating groups HG1, HG2, HG3 is selected so that first heating group HG1 has the lowest steam pressure PD; that second heating group HG2 has the second lowest steam pressure PD and that the third heating group HG3 has the highest steam pressure PD.

Figure 2A:
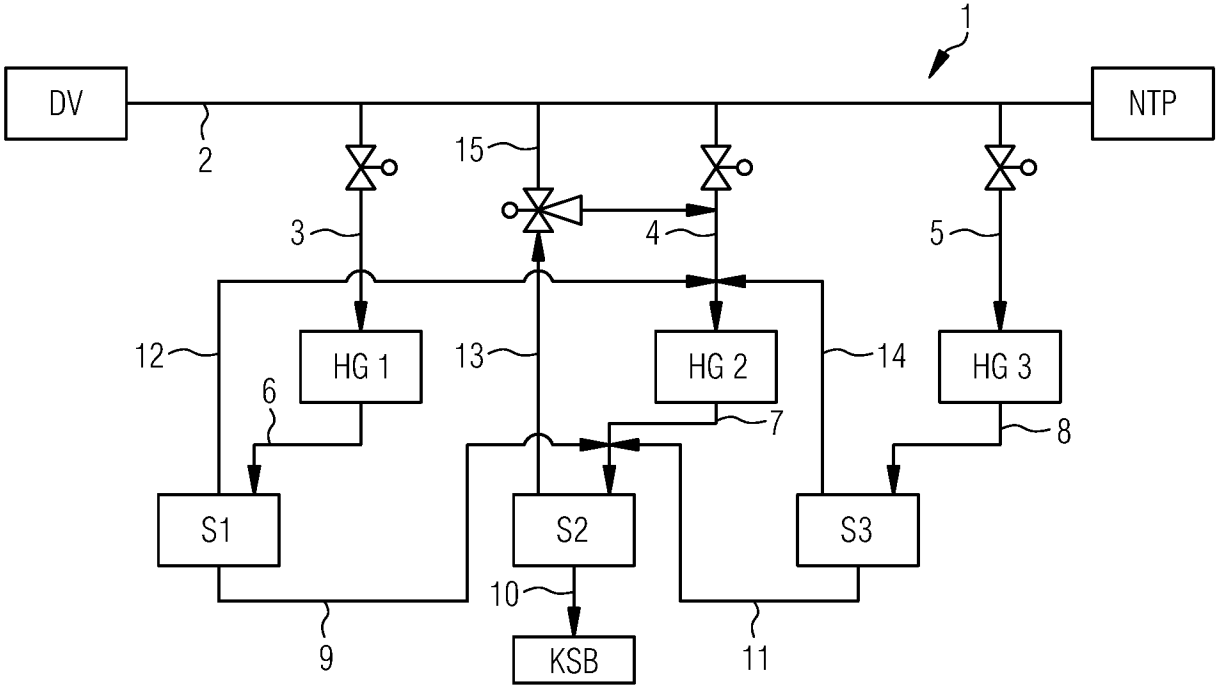
FIG. 2*a* is a schematic illustration of an embodiment of a heating group subsystem according to the present invention.
Figure 2B:
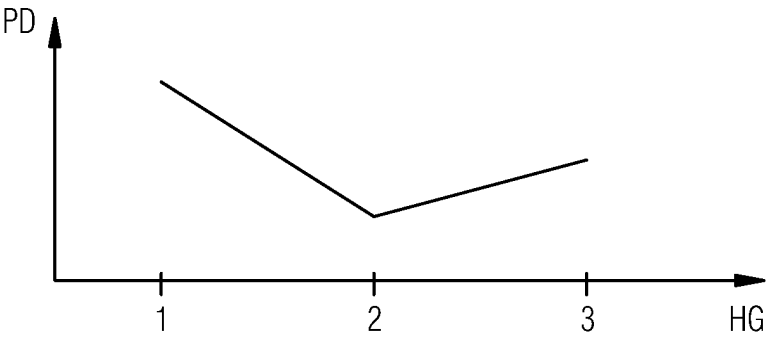
FIG. 2*b* illustrates the steam pressure of the heating steam of the individual heating groups of a heating group subsystem according to the present invention.

Referring now to FIG. 2*a*, there is shown a schematic illustration of an exemplary embodiment of a heating group subsystem according to the present invention for a dryer section in a paper machine with dryer cylinders, comprising 3 heating groups HG1, HG2, HG3. The heating groups are heated with heating steam. Steam feed lines 3, 4, 5 are connected with a steam supply line 2. Steam supply lines 2 are supplied with heating steam via a steam supply system DV. Heating groups HG1, HG2, HG3 are arranged one after the other in machine direction. Heating group HG1 thus represents the first heating group and supplies one or more first dryer cylinders with heating steam. Steam supply line 2 also supplies an after-dryer section NTP with steam. The steam pressure of the respective heating steam is independently adjustable for each heating group HG1, HG2, HG3 through valves. After the heating steam of a heating group HG1, HG2, HG3 has flowed through the dryer cylinder or cylinders, the mixture of exhaust vapor and condensate is fed through discharge lines 6, 7, 8 to a respective separator S1, S2, S3 for separation of exhaust vapor and condensate. The condensate of heating group 2 is fed via condensate line 10 to a condensate collection tank. The condensate of heating group 1 is fed from separator 1 via condensate line 9 to discharge line 7. Accordingly, the condensate of heating group 3 is fed from separator 3 via condensate line 11 also to discharge line 7 of heating group 2. The exhaust vapor of heating group HG3 is fed from separator 3 via exhaust vapor line 14 to steam feed line 4 of second heating group HG2 and is again used directly for paper drying. Accordingly, the exhaust vapor of heating group HG1 is fed from separator 1 via exhaust vapor line 12 to steam feed line 4 of second heating group HG2 and is again used directly for paper drying. In contrast, the exhaust vapor of heating group HG2 is returned through exhaust vapor line 13 via a thermo-compressor from separator 2 into steam feed line 4 of second heating group HG2 and is thus also used again directly for paper drying. Thermo-compressor 15 acts as a jet pump, wherein steam from steam supply line 2 is used as a propulsion jet. The pressure of the exhaust vapor from separator 2 of heating group HG2 is thereby brought at least to the pressure level of the heating steam in steam feed line 4. As shown in FIG. 2*b*, in contrast to the cascade system, steam pressure PD of the heating steam in heating groups HG1, HG2, HG3 is selected so that first heating group HG1 has the highest steam pressure PD; that second heating group HG2 has the lowest steam pressure PD and third heating group HG3 has a steam pressure PD between the steam pressure of first heating group HG1 and second heating group HG2.

Figure 3:
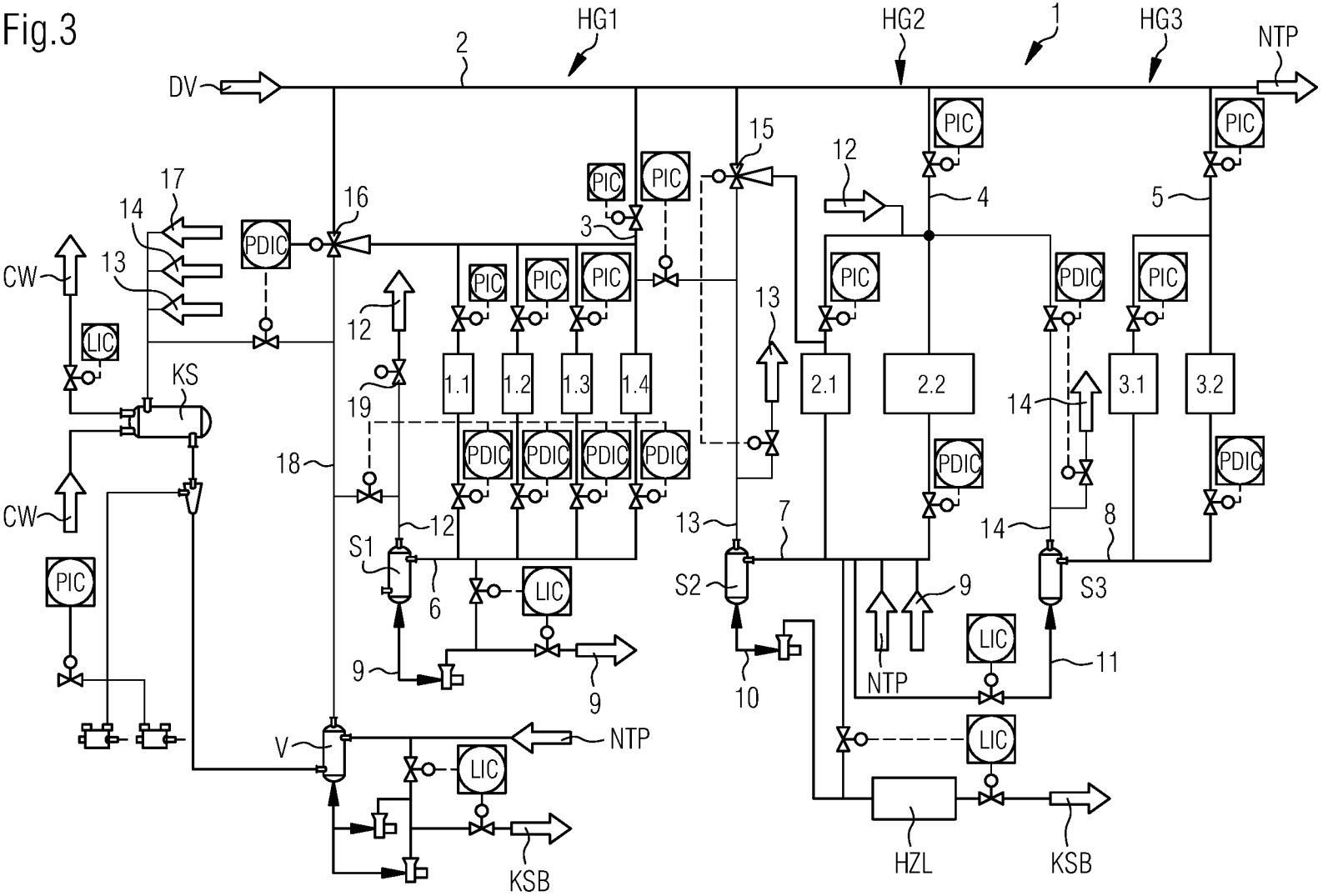
FIG. 3 illustrates another embodiment of a heating group subsystem according to the present invention.

FIG. 3 illustrates further details of an embodiment of a heating group subsystem according to FIGS. 2*a* and 2*b* for a dryer section in a paper machine with dryer cylinders 1.1, 1.2, 1.3, 1.4, 2.1, 2.2, 3.1, 3.2 and including 3 heating groups HG1, HG2, HG3. The heating groups are heated with heating steam. Steam feed lines 3, 4, 5 are connected with a steam supply line 2. Steam supply lines 2 are supplied with heating steam from a steam supply system DV. First heating group HG1 comprises dryer cylinders 1,1, 1.2, 1.3, 1.4; second heating group HG2 comprises dryer cylinders 2.1, 2.2 and third heating group HG3 comprises dryer cylinders 3.1, 3.2. In respect to machine direction, heating groups HG1, HG2, HG3 are arranged one after another. Heating group HG1 thus represents the first heating group and supplies several first dryer cylinders 1.1, 1.2, 1.3, 1.4 with heating steam. Steam supply line 2 also supplies an after-dryer section NTP or another steam consuming device with steam. The steam pressure of the respective heating steam is independently adjustable for each heating group HG1, HG2, HG3 through valves. After the heating steam of a heating group HG1, HG2, HG3 has flowed through the dryer cylinder or cylinders, the mixture of exhaust vapor and condensate is fed through discharge lines 6, 7, 8 to a respective separator S1, S2, S3 for separation of exhaust vapor and condensate. The condensate of heating group 2 is fed through a condensate line 10 to a condensate collecting tank, whereby previously heat for the hood supply air HZL for the hood of the dryer section was removed. The condensate of heating group 1 is fed from separator 1 via condensate 9 to discharge line 7. Accordingly, condensate of heating group 3 is fed from separator 3 via condensate line 11 also to discharge line 7 of heating group 2. The exhaust vapor of heating group HG3 is fed from separator 3 via exhaust vapor line 14 to steam feed line 4 of second heating group HG2 and is again used directly for paper drying. Accordingly, the exhaust vapor of heating group HG1 is fed from separator 1 via exhaust vapor line 12 to steam feed line 4 of second heating group HG2 and is again used directly for paper drying. In contrast, the exhaust vapor of heating group HG2 is returned through exhaust vapor line 13 via a thermo-compressor 15 from separator 2 into steam feed line 4 of second heating group HG2 and is thus also used again directly for paper drying. Thermo-compressor 15 acts as a jet pump, wherein steam from steam supply line 2 is used as a propulsion jet. It is however also conceivable to supply thermo-compressor 15 with steam from another steam supply net, for example a steam supply net that has a higher steam pressure. The pressure of the exhaust vapor from separator 2 of heating group HG2 is thus brought at least to the pressure level of the heating steam in steam feed line 4. As shown in FIG. 2*b*, in contrast to the cascade system, steam pressure PD of the heating steam is selected in heating groups HG1 HG2, HG3 so that first heating group HG1 has the highest steam pressure PG; that second heating group HG2 has the lowest steam pressure PD and third heating group HG3 has a steam pressure PD between the steam pressure of first heating group HG1 and second heating group HG2.

It is also possible to provide additional heating groups between first heating group HG1 and last heating group HG3, wherein these additional heating groups also have a steam pressure that is less than the steam pressure of first heating group HG1 and less than the steam pressure of the last heating group, which in this example is third heating group HG3. Condensate lines 9, 10, 11 and vapor lines 12, 13, 14 can then be connected consistent with the heating group subsystem illustrated in FIG. 3 with the steam feed lines or respectively the discharge lines of one of the at least one additional heating group or second heating group HG2.

In the event of a web break in the paper machine, in other words in an event outside of normal operating procedure, valves and vapor lines 12, 13, 14 are provided as shown by arrows, in order to feed the vapors directly to a condenser KS. In addition, vapor lines 17 from other heating groups which are not illustrated in this embodiment, can be connected with this condenser. Condenser KS is connected with lines CW for supply and discharge of cooling water.

Heating group subsystem 1 also includes a vacuum separator V into which the condensate lines from an after-dryer section NTP flow. From this, vacuum separator V produces exhaust vapor which is fed directly into condenser KS.

The arrangement in FIG. 3 provides an optional thermo-compressor 16 with which it is possible to operate heating group subsystem 1 as a classic cascade heating system—for example for production of certain paper types. Thermo-compressor 16 acts as a jet pump, wherein steam from steam supply line 2 is used as a propulsion jet. It is however also conceivable to supply thermo-compressor 16 with steam from another steam supply net, for example a steam supply net that has a higher steam pressure. In this case—viewed in machine direction—first heating group HG1 of heating group subsystem 1 has the lowest steam pressure of heating steam of all heating groups HG2, HG3 of heating group subsystem 1; and second heating group HG2 of heating group subsystem 1 has the second lowest steam pressure and third heating group HG3 has the highest steam pressure of heating steam. This thermo-compressor 16 is connected with vapor line 18 and with steam supply line 2. In the case of cascade operation of heating group subsystem 1 it is thus possible to return the vapor occurring in separator Si and in vacuum separator V into steam feed line 3 of heating group HG1 and to use it directly for paper drying. For this case, vapor line 12 of first heating group HG1 comprises a check-valve 19 to prevent backflow of heating steam from steam feed line 4 via vapor line 12 into separator S1 of first heating group HG1, or into vacuum separator V.

If heating group subsystem 1 is operated according to the invention and not in the cascade operational mode, thermo-compressor 16 may be taken out of operation. Thermo-compressor 16 can also be operated with steam from another steam net, for example a steam supply net that has a higher steam pressure. The pressure of the exhaust vapor from vacuum separator V can thus be brought at least to the pressure level of the heating steam in steam feed line 3 and can be used directly for paper drying.

The valves in steam supply lines 3, 4, 5 are connected with pressure regulating systems PIC to regulate the steam pressure of the respective heating steam, and the valves for discharge lines 6, 7, 8 are coupled with pressure differential control systems PDIC. The valves in condensate lines 9, 10, 11 are equipped with level controllers LIC.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION

1 Heating group subsystem
2 Steam supply line
3 Steam feed line
4 Steam feed line
5 Steam feed line
6 Discharge line
7 Discharge line
8 Discharge line
9 Condensate line
10 Condensate line
11 Condensate line
12 Vapor line
13 Vapor line
14 Vapor line
15 Thermo-compressor
16 Thermo-compressor
17 Vapor line
18 Vapor line
19 Check valve
DV Steam supply system
NTP After-dryer section
HG1 Heating group 1
1.1 Dryer cylinder
1.2 Dryer cylinder
1.3 Dryer cylinder
1.4 Dryer cylinder
HG2 Heating group 2
2.1 Dryer cylinder
2.2 Dryer cylinder
HG3 Heating group 3
3.1 Dryer cylinder
3.2 Dryer cylinder
S1 Separator 1
S2 Separator 2
S3 Separator 3
KS Condenser
KSB Condenser collecting tank
HZL Hood supply
V Vacuum separator
CW Cooling water

What is claimed is:

1. A method for operating a heating group subsystem in a machine for a production or treatment of a fibrous web, comprising:

providing a first heating group including at least one first device that is heated with a pressurized heating steam, at least one additional heating group including at least one additional device that is heated with a pressurized heating steam, and a last heating group including at least one last device that is heated with a pressurized heating steam;

feeding the fibrous web, when viewed in a direction of travel, first through the first heating group, then through said least one additional heating group and thereafter through the last heating group; and adjusting a steam pressure of said pressurized heating steam of said at least one additional heating group lower than a steam pressure of said pressurized heating steam of the first heating group and a steam pressure of said pressurized heating steam of said last heating group.

2. The method according to claim 1, further including a step of adjusting the steam pressure of the pressurized heating steam of the first heating group one of equal to or higher than the steam pressure of the pressurized heating steam of said last heating group.

3. The method according to claim 2, wherein the steam pressure of the pressurized heating steam of said at least one additional heating group is adjusted within a range between 50 kPa and 700 kPa.

4. The method according to claim 1, further including a step of feeding the respective pressurized heating steam—after flowing through the respective said at least one first device, said at least one additional device, and said at least one last device—to a respective separator for respectively separating a condensate and an exhaust vapor, and in that the exhaust vapor of the first heating group and the exhaust vapor of said at least one additional heating group and the exhaust vapor of the last heating group are respectively fed to the respective pressurized heating steam of at least one of said at least one first device, said at least one additional device, and said at least one last device which is heated with the pressurized heating steam of said at least one additional heating group.

5. The method according to claim 4, wherein the exhaust vapor of said at least one additional heating group is fed via a thermocompressor to the pressurized heating steam of at least one of said at least one first device, said at least one additional device, and said at least one last device which is heated with pressurized heating steam of said at least one additional heating group.

6. The method according to claim 1, wherein the machine comprises one of a dryer section, a pre-dryer section, and an after-dryer section, and, viewed in a machine direction, the heating group subsystem is provided at one of a beginning of the dryer section, at a beginning of the pre-dryer section, and at a beginning of the after-dryer section.

7. The method according to claim 1, wherein said at least one first device, said at least one additional device, and said at least one last device are respectively in the form of at least one first drying cylinder, at least one additional drying cylinder, and at least one last drying cylinder.

8. A heating group subsystem for a machine for a production or treatment of a fibrous web, comprising:

a first heating group including at least one first device that is heated with a pressurized heating steam;

at least one additional heating group including at least one additional device that is heated with a pressurized heating steam; and a last heating group including at least one last device that is heated with a pressurized heating steam, wherein the fibrous web—viewed in a machine direction—is guided first through the first heating group, then through said at least one additional heating group, and thereafter through the last heating group such that a steam pressure of the pressurized heating steam of said at least one additional heating group is lower than a steam pressure of the pressurized heating steam of the first heating group and a steam pressure of the pressurized heating steam of the last heating group.

9. The heating group subsystem according to claim 8, wherein the steam pressure of the pressurized heating steam of the first heating group is one of equal to or higher than the steam pressure of the pressurized heating steam of the last heating group.

10. The heating group subsystem according to claim 8, further including a respective steam feed line, a respective discharge line, and a respective separator for each heating group, and thus, for each said at least one first device, said at least one additional device, and said at least one last device, respectively, and each said at least one device is connected via the respective steam feed lines with a first steam supply line, and that each said respective separator is allocated to each heating group for respectively separating a condensate and an exhaust vapor that is respectively connected via each said respective discharge line with said respective heating group and each respective device.

11. The heating group subsystem according to claim 10, wherein said separator of the first heating group and said separator of said at least one additional heating group and said separator of the last heating group are connected via a respective vapor line with a second steam supply line of the at least one additional heating group.

12. The heating group subsystem according to claim 11, wherein said vapor line for a vapor from said separator of said at least one additional heating group is connected via a thermo-compressor with said second steam supply line of said at least one additional heating group for a purpose of condensation, and wherein said thermo-compressor is connected with said first steam supply line.

13. The heating group subsystem according to claim 10, wherein said first heating group further includes a first condensate line, and said at least one additional heating group further includes a second condensate line, and said first and second condensate lines are connected with said discharge line of said at least one additional device of said at least one additional heating group.

14. The heating group subsystem according to claim 11, wherein said vapor line of said first heating group comprises a backflow prevention device.

15. The heating group subsystem according to claim 14, wherein said backflow prevention device is in the form of a check valve.

16. The heating group subsystem according to claim 8, further including a vacuum separator which is connected via a vapor line with a thermocompressor, and a vapor of said vacuum separator is condensed by said thermocompressor and is fed to a steam supply line of said first heating group.

17. The heating group subsystem according to claim 8, wherein the machine comprises one of a dryer section, a pre-dryer section, and an after-dryer section, and, viewed in the machine direction, the heating group subsystem is provided at one of a beginning of the dryer section, at a beginning of the pre-dryer section, and at a beginning of the after-dryer section.

18. The heating group subsystem according to claim 8, wherein said at least one first device, said at least one additional device, and said at least one last device are respectively in the form of at least one first drying cylinder, at least one additional drying cylinder, and at least one last drying cylinder.

* * * * *